US007287645B2

(12) United States Patent
Hyun

(10) Patent No.: US 7,287,645 B2
(45) Date of Patent: Oct. 30, 2007

(54) EGGS PACKING CONTAINER USING PAPERBOARD

(75) Inventor: Yong Wook Hyun, Seoul (KR)

(73) Assignee: Beonecnr Co., Ltd. (KR)

( * ) Notice: Subject to any disclaimer, the term of this patent is extended or adjusted under 35 U.S.C. 154(b) by 555 days.

(21) Appl. No.: 10/495,442

(22) PCT Filed: Nov. 16, 2002

(86) PCT No.: PCT/KR02/02146

§ 371 (c)(1),
(2), (4) Date: May 12, 2004

(87) PCT Pub. No.: WO03/042070

PCT Pub. Date: May 22, 2003

(65) Prior Publication Data

US 2005/0023176 A1 Feb. 3, 2005

(30) Foreign Application Priority Data

Nov. 17, 2001 (KR) ..... 10-2001-0071567

(51) Int. Cl.
*B65D 81/02* (2006.01)

(52) U.S. Cl. ..... 206/521.1; 206/521.6; 206/521.7

(58) Field of Classification Search .. 206/521.1–521.9, 206/507, 508; 229/87.02, 125.36
See application file for complete search history.

(56) References Cited

U.S. PATENT DOCUMENTS

| | | | | | |
|---|---|---|---|---|---|
| 705,286 | A | * | 7/1902 | Palmer | 206/521.7 |
| 915,294 | A | * | 3/1909 | Hilliker | 206/521.7 |
| 2,130,378 | A | * | 9/1938 | Bueschel | 206/521.15 |
| 2,152,649 | A | * | 4/1939 | Bartlett | 206/521.15 |
| 2,776,082 | A | * | 1/1957 | Bennorth | 206/521.7 |
| 3,167,235 | A | * | 1/1965 | Hailey et al. | 206/521.7 |
| 3,173,598 | A | * | 3/1965 | Buttery | 206/521.15 |
| 4,934,533 | A | * | 6/1990 | Roila | 206/521.7 |
| 5,848,699 | A | * | 12/1998 | Pettersson | 206/521.1 |

* cited by examiner

*Primary Examiner*—Mickey Yu
*Assistant Examiner*—Steven A. Reynolds
(74) *Attorney, Agent, or Firm*—Galgano & Associates, PLLC

(57) ABSTRACT

The present invention relates to an eggs packing container, and more particularly, to an eggs packing container using paperboard to produce box structures and packed-material supporters provided therein, thereby preventing the environments from pollution and effectively preventing received eggs from the damages due to any external impact. The eggs packing container according to the present invention has a receiving portion 100 and a lid portion 200 like the shape of the conventional synthetic resin packing container, thereby making use of the existing egg packing production automation facilities.

8 Claims, 8 Drawing Sheets

EGGS PACKING CONTAINER USING PAPERBOARD

TECHNICAL FIELD

The present invention relates to an eggs packing container, and more particularly, to an eggs packing container using paperboard to produce box structures and packed-material supporters provided therein, thereby preventing the environments from pollution and effectively preventing received eggs from the damages due to any external impact.

BACKGROUND ART

Recently, various types of synthetic resin packing containers which are manufactured by thin-molding have been used for packing and selling eggs.

The synthetic resin packing containers consist of a receiving portion and a lid potion. The receiving portion has egg inserting plates with the same shapes as the eggs to prevent the received eggs from moving. The lid portion has a shape of plate plane. Since the eggs receiving portion has egg inserting plates with the same shapes as the eggs, the surfaces of the received eggs are closely contacted with supporters. Therefore, any external impact to the container is directly applied to the eggs though the supporters, and then the eggs received in the container may be easily damaged. In addition, the synthetic resin has characteristics that it can not be easily dissolved in nature and also, if incinerated, may emit poisonous gases, so that the synthetic resin packing containers would induce environment pollution.

Recently, recycled paper has been used for eggs packing containers instead of the synthetic resin, but the eggs packed in the eggs packing containers made of the recycled paper has been still exposed to damages.

A packing container produced with corrugated cardboard in order to protect the environments from pollution is disclosed in Korean Registered Utility Model No. 20-0188239. The packing container is produced on a single sheet of the corrugated cardboard by means of press processing. Although the packing container according to the Utility Model has much more advantage than the conventional synthetic resin containers, it has still disadvantages in the related industries. The corrugated cardboard used as a packing container has to be assembled into a container though many steps of folding processes. Therefore it takes a lot of time and labor to carry out tho folding processes. The production of the cardboard container has difficulty in time and cost. Furthermore, the production of the cardboard container is not suitable for the production automation.

On the other hand, another packing container made of cardboard was developed by Bergstein in U.S.A., 1962. In the packing container, side portion of the egg was subjected to be held with mechanisms having a series of reverse triangular grooves, which are V-shaped receiving holes. However, the V-shaped receiving holes of the packing container were not suitable for receiving eggs, so that many of eggs were broken in receiving process. And also, in delivery process, some eggs were bumped each other due to the fold lines of the cardboard container.

In addition, a packing container disclosed in U.S. Pat. No. 2,460,020 is shown in FIG. 14. The packing container has large space between receiving holes, and therefore its volume is too much increased. Moreover, it has several wings disposed in its receiving holes so that it is inconvenient for receiving eggs.

In similarity to the container disclosed in the Korean Registered Utility Model, the above mentioned packing containers using corrugated cardboard have also no structure suitable for production automation which is eagerly needed in the related industries.

DISCLOSURE OF THE INVENTION

The present invention is provided to solve the above mentioned problems. An object of the present invention is to provide an eggs packing container using paperboard, thereby safely receiving eggs, preventing the environments from pollution, and making use of the existing production automation facilities associated with standards of the conventional synthetic resin packing containers.

Another object of the present invention is to provide an eggs packing container which is suitable for automation of assembling and make use of the existing eggs automation facilities.

Still another object of the present invention is to provide an eggs packing container which is insensitive to external impact and is stabilized.

In order to accomplish the above objects, the present invention provides an eggs packing container in which a receiving portion 100 and a lid portion 200 are produced using a single sheet of paperboard, wherein: the receiving portion 100 comprises a lower surface 41 being a bottom plane of the receiving portion 100, and having a support projection 40*a*; a first egg inserting plate 25 being positioned above the lower surface 41, and having a support hole 40*b* combined with the support projection 40*a* of the lower surface and a plurality of first inserting holes 45 for inserting received eggs, the support projection 40*a* for keeping a distance from a first egg inserting plate 25 constant and fixing said first egg inserting plate 25; a second egg inserting plate 27 being positioned above the first egg inserting plate 25, and having a plurality of second inserting holes 35 disposed at opposite positions to the plurality of first inserting holes 45 of the first egg inserting plate 25 and a support holes 140*c*; a first side surface 28 for connecting the second egg inserting plate 27 with the lower surface 41, wherein a combining hole 50*a* for combining the receiving portion 100 with the lid portion 200 is provided at a central region of the first side surface; a first connecting stripe 26 for connecting the first egg inserting plate 25 with the second egg inserting plate 27, and having a supporter 61; a second connecting stripe 21 being connected to the first egg inserting plate 25, being adhered to the first side surface, and having a fixing projection 30*a* for supporting the first side surface; and a second side surface 11 being adhered to the first connecting stripe 26, and connecting the receiving portion 100 with the lid portion 200, and the lid portion 200 comprises an upper surface 12 for fixing the receiving portion 100 and the lid portion 200, having a support projection 140*a* thereby preventing the eggs packing container from moving; a moving prevention part 14 having a third engaging hole 15 and a support hole 140*b*, wherein the third engaging hole 15 is disposed opposite to the second engaging hole 35 and the support hole 140*b* is combined with the support projection 140*a*; a third connecting stripe 16 being connected with the moving prevention part 14; a third side surface 10 being adhered to the third connect stripe 16 and connecting the receiving portion 100 with the lid portion 200; and a fourth side surface 13 connecting the upper surface 12 with the moving prevention part 14, being provided with a combining projection 50*b*, thereby combining the receiving portion 100 with the lid portion 200.

BRIEF DESCRIPTION OF DRAWINGS

The above and other objects, advantages and features of the present invention will become apparent from the following description of preferred embodiments given in conjunction with the accompanying drawings, in which.

BEST MODE FOR CARRYING OUT THE INVENTION

The preferred embodiments according to the present invention will be now described in detail with reference to the accompanying drawings.

Figure 1:
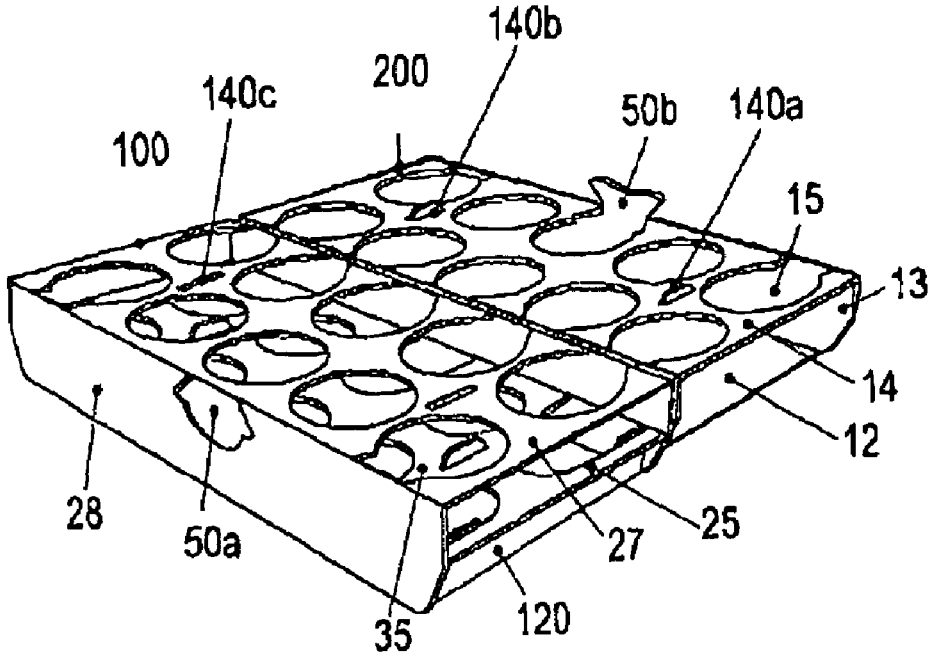
FIG. 1 is a view illustrating an eggs packing container according to the present invention.
Figure 2:
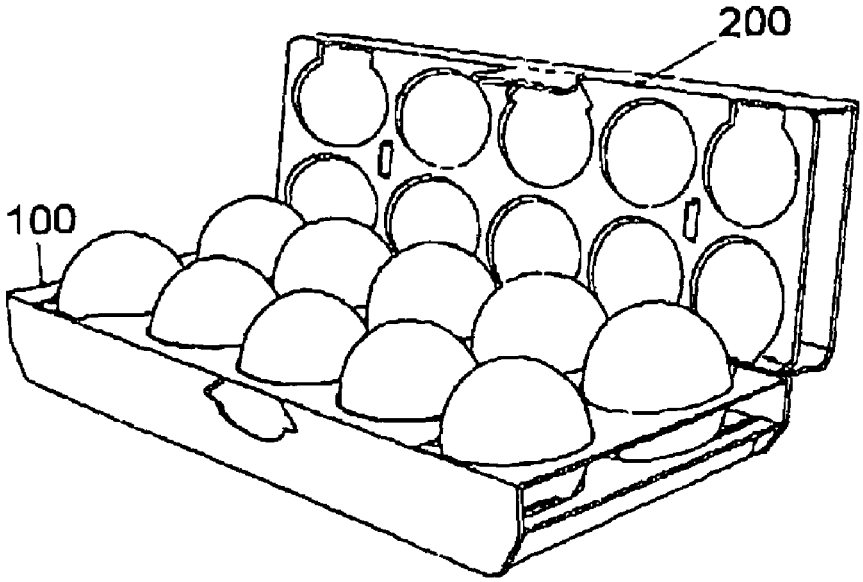
FIG. 2 is a perspective view illustrating an eggs packing container with eggs being received according to the present invention.
Figure 3:
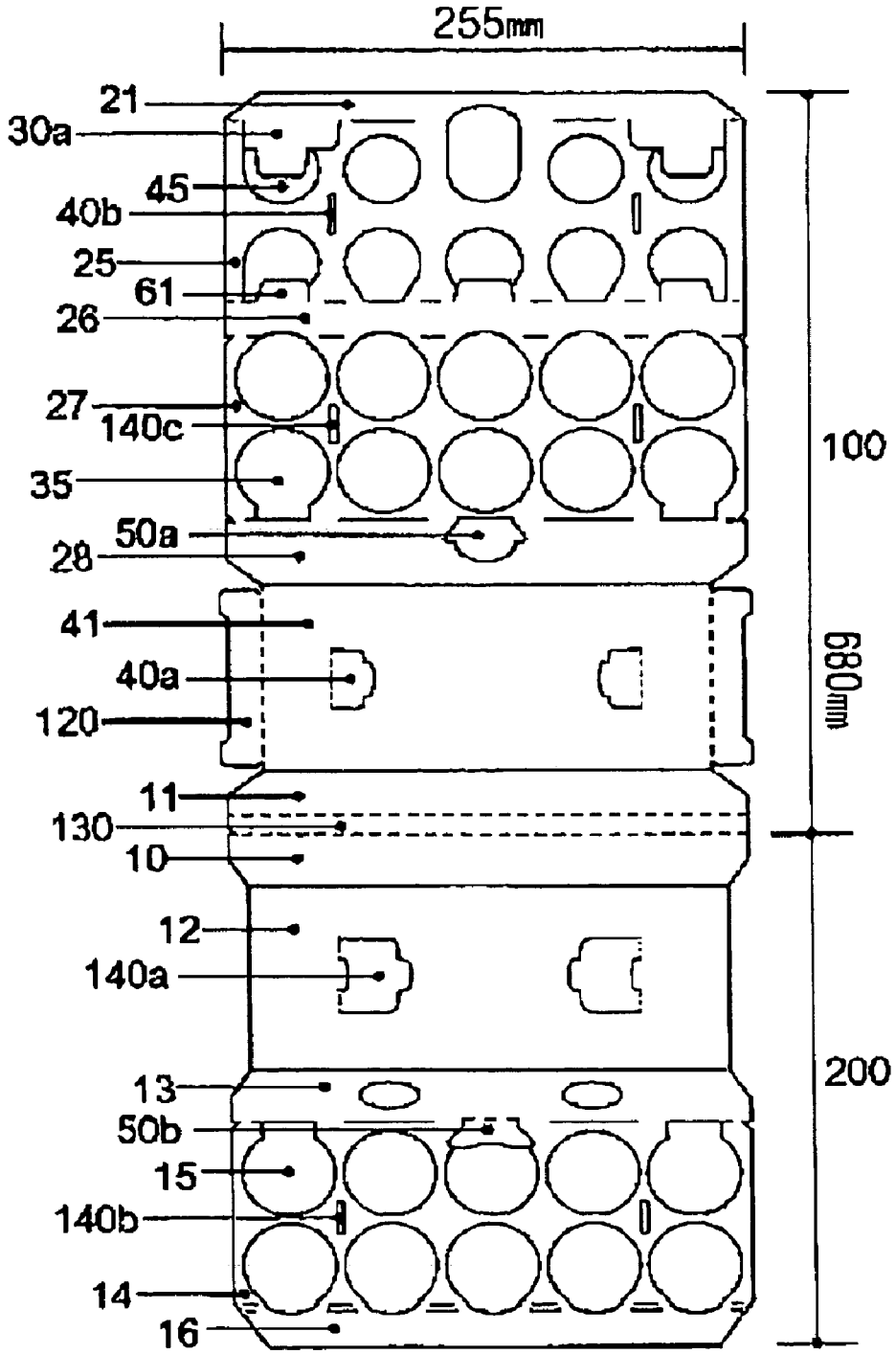
FIG. 3 is a development view illustrating an eggs packing container according to the present invention.

FIG. 1 is a perspective view illustrating an eggs packing container according to the present invention, and FIG. 3 is a development view illustrating an eggs packing container according to the present invention. In addition, FIG. 2 is a perspective view illustrating an eggs packing container with eggs being received according to the present invention.

As shown in FIGS. 1 and 3, the eggs packing container has a receiving portion 100 and a lid portion 200 which are formed with a single sheet. FIG. 1 shows the eggs packing container accomplished by procedure of assembling which is carried out by folding the single sheet along fold lines (indicated as dotted lines) according to the development view of FIG. 3.

The receiving portion 100 and the lid portion 200 will be described in detail with reference to FIG. 1. As shown in FIG. 1, the packing container according to the present invention is made of a single sheet which is manufactured in one press processing. The single sheet is folded through a sequence of simple assembling procedures in accordance with the fold lines formed on the surface of the sheet in order to shape the packing container.

First, the receiving portion 100 for receiving eggs will be described. The receiving portion 100 has a lower surface 41, which is a bottom plane of the container, a first egg inserting plate 25 and a second egg inserting plate 27 which serve as a space for receiving eggs. The first and second egg inserting plates 25 and 27 are formed on the lower surface 41 in a stack structure. Further, the receiving portion 100 has supporters that prevent the stack structure of the first and second egg inserting plates 25 and 27 from moving and keeps a spacing distance between the first egg inserting plate 25 and the lower surface 41 constant in order to give the container resistance against an external impact. The supporters consist of a plurality of support holes 40*b* and the corresponding support projections 40*a*. The support projections 40*a* are formed on the lower surface 41, and the support holes 40*b* are formed on the first inserting plate 25. In order to accomplish the support, the support projections 40*a* are folded along the associated fold lines toward the interior and then put into the corresponding support holes 40*b*. Generally, an egg has an oval shape in which its middle part is convex. Therefore, the support holes 45 of the first egg inserting plate 25 is formed to be smaller that the support holes 35 of the second egg inserting plate 27 corresponding to the middle part of the received egg, so that the received egg may be prevented from moving.

Further, the receiving portion 100 has a first side surface 28 and a second side surface 11, which form the side surfaces of the receiving portion 100. The receiving portion 100 has a first connecting stripe 26 having projection members upwards and downwards for connecting the first egg inserting plate 25 and the second egg inserting plate 27, and a second connecting stripe 21 connected with the first egg inserting plate 25. The second connecting stripe 21 has fixing projections 30*a*. The first side surface 28 connects the second egg inserting plate 27 to the lower surface 41 and is provided with a combining hole 50*a* at the center thereof to combine the receiving portion 100 and the lid portion 200. The combining projection 50*b*, as described below, which is formed on a fourth side surface 13 of the lid portion 200 is inserted into the combining hole 50*a*. The first connecting stripe 26 is folded outwards to adhere to the second side surface 11. The first connecting stripe 26 is provided with supporters 61, which separate the first egg inserting plate 25 from the lower surface 41 and have a function of supporting the receiving portion 100. The second connecting stripe 21 has a function of supporting the receiving portion 100 and keeps the spacing distance from the lower surface 41 constant, similar to the supporters 61 formed on the first connecting stripe 26. In addition, the fixing projections 30*a* formed on the second connecting stripe 21 keep the spacing distance between the first egg inserting plate 25 and the second egg inserting plate 27 constant and has a function of supporting the second egg inserting plate 27.

Preferably, the lower surface 41 may be provided with bottom engaging panels 120 in order to prevent damaged eggs from moving within the receiving portion 100.

Now, the lid portion 200 having a function of covering the eggs packing container according to the present invention will be described.

As shown in FIGS. 1 and 3, the lid portion 200 comprises an upper surface 12, moving prevention parts 14, a third connecting stripe 16, a third side surface 10, and a fourth side surface 13. The upper surface 12 of the lid portion 200 constructs the outer appearance of the packing container along with the corresponding lower surface 41 of the receiving portion 100. The upper surface 12 is provided with a plurality of holes so that it is possible for customers to check out the sizes and states of the received eggs without opening the packing container.

The moving prevention parts 14 are provided with a plurality of engaging holes 15 which are disposed at the positions of the lid portion 200 corresponding to the engaging holes 35 of the second egg inserting plate 27 in order to further hold the received eggs, which is held through the engaging holes 35 and 45 of the receiving portion 100. The third connecting stripe 16 is connected to the moving prevention parts 14. The third side surface 10 is adhered to the third connecting stripe 16 to connect the receiving portion 100 with the lid portion 200. The fourth side surface 13 connects the upper surface 12 with the moving prevention parts 14, and is also provided with a combining projection 50*b* to combine the receiving portion 100 with the lid portion 200. The eggs packing container according to the present invention is accomplished by adhering the first connecting stripe 26 to the second side surface 11 and adhering the third connecting strips 16 to the third side surface 10. The adhering procedure may be carried out by means of various commercial adherents.

Preferably, the third side surface 10 may have side surface cutting elements 130 in order to easily separate the receiving portion 100 from the lid portion 200.

The support projections 140*a* of the upper surface 12 are combined with the support holes 140*c* of the second egg inserting plate 27 and the support holes 140*b* of the moving prevention parts 14, thereby having a function of fixing the receiving portion 100 and the lid portion 200.

Figure 4:
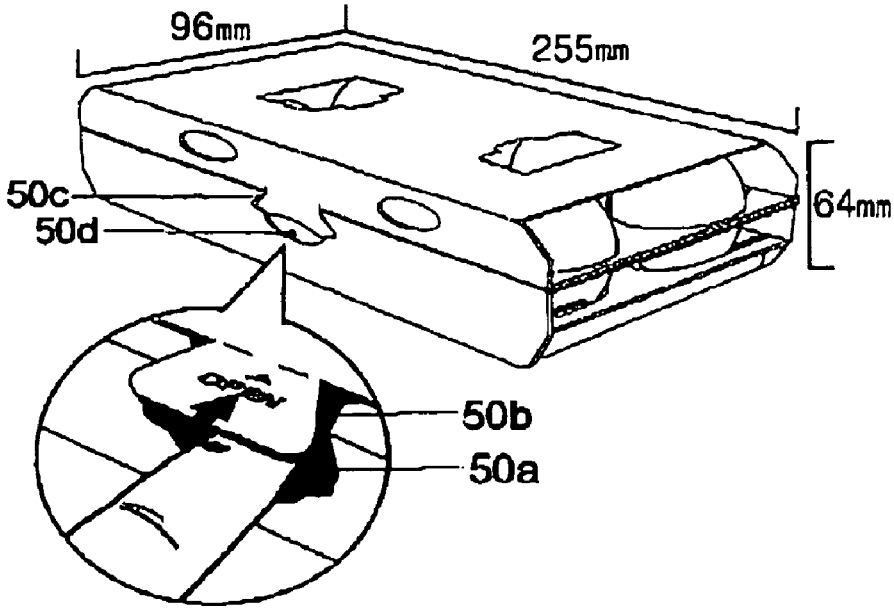
FIG. 4 is a view illustrating a structure of a combining hole of a receiving portion and a combining projection of a lid portion and its usage in an eggs packing container according to the present invention.

FIG. 4 is a view illustrating a structure of a combining hole of a receiving portion and a combining projection of a lid portion and its usage in an eggs packing container according to the present invention. FIG. 4 also illustrates operations of combining the combining hole 50*a* with the combining projection 50*b* in order to combine the receiving portion 100 with the lid portion 200, and illustrates their combined state. As shown in FIG. 4, the combining projection 50*b* formed on the fourth side surface 13 are put into the combining hole 50*a* formed on the first side surface 28, thereby the receiving portion 100 being combined with the lid portion 200. In FIG. 4, reference numeral 5*c* indicates the combining structure where the combining projection 50*b* are combined with the combining hole 50*a*. Since the eggs packing container according to the present invention have such a combining structure, users of the container can release the combined packing container without breakage of the combining structure, and in turn combine the released packing container. The combining projection 50*b* has characteristics that its width becomes gradually narrower from its lower part to its upper part. In addition, the upper part of the combining hole 50*a* has the same size and shape as the combing projection 50*b*, thereby being engaged therewith. And also, the lower part of the combining hole 50*a* makes ensure that users can have wider space for opening and closing the container. The combining hole 50*a* is combined with the combining projection 50*b*, having the same size as the combining projection 50*b*, thereby opening and closing the packing container without its damage. In the state that the receiving portion 100 and the lid portion 200 are not combined, the second and third side surfaces 11 and 10 are forced to be completely folded out along the boarder line therebetween. Therefore, at the time of combining the combing projection 50*b* with the combining hole 50*a*, the combining projection 50*b* has a property of rising upward due to paperboard having a property of unfolding itself. In the present invention, since the combining projection 50*b* and the combining hole 50*a* have structures that their width become gradually narrower from their lower parts to their upper parts and the paperboard has the property of unfolding, which lead to the property of rising up of the combining projection 50*b* as described above, so that the packing container can he more tightly combined.

Figure 5:
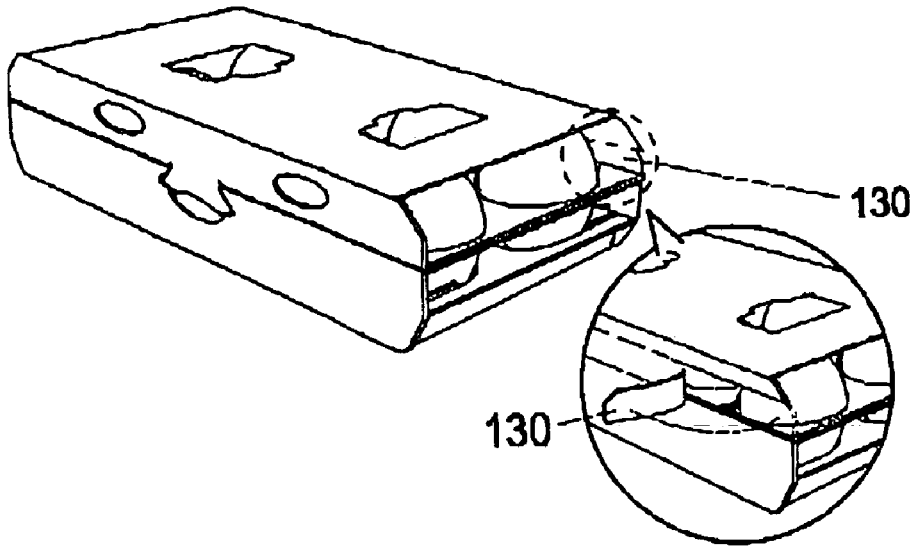
FIG. 5 is a view illustrating usage of a side surface cut part for easily separating a receiving portion from a lid portion in an eggs packing container according to the present invention.

FIG. 5 is a view illustrating usage of a side surface cutting element for easily separating a receiving portion from a lid portion in an eggs packing container according to the present invention.

As shown in FIG. 5, the side surface cutting element 130 provided on the third side surface 10 of the packing container is cut off the packing container along the cut lines so that the receiving portion 100 and the lid portion 200 of the packing container may be easily separated each other.

Figure 6:
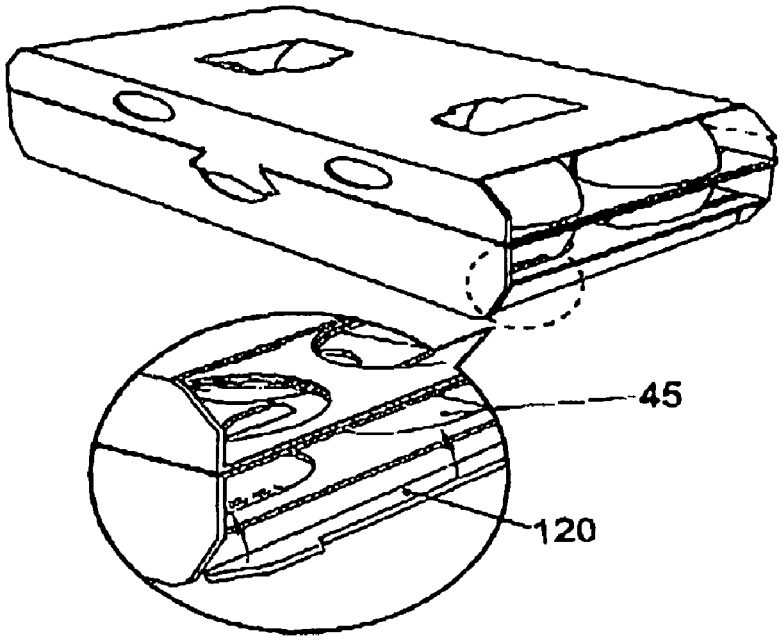
FIG. 6 is a view illustrating a state of bottom engaging panels for preventing contained materials from flowing out in the event of damage of packed eggs in an eggs packing container according to the present invention from movement.

FIG. 6 is a view illustrating a state of bottom engaging panels for preventing contained materials from flowing out in the event of damage of packed eggs in an eggs packing container according to the present invention.

As shown in FIG. 6, the lower surface 41 which is the bottom plane of the packing container is provided with the bottom engaging panels 120 which prevent the contained materials from flowing out and contaminating other adjacent packing containers in case that some of the received eggs are damaged. The bottom engaging panels are combined into the first engaging holes 45 of the first egg inserting plate 25 to be fixed thereto.

Figure 7:
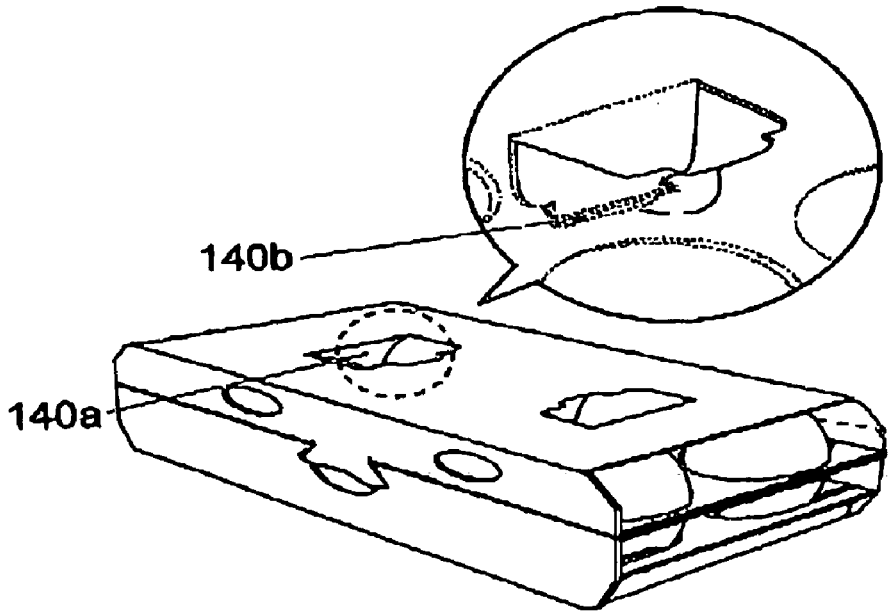
FIG. 7 is a view illustrating a state that support holes and support projections of a lid portion are combined together in order to prevent an eggs packing container according to the present invention from moving.
Figure 8:
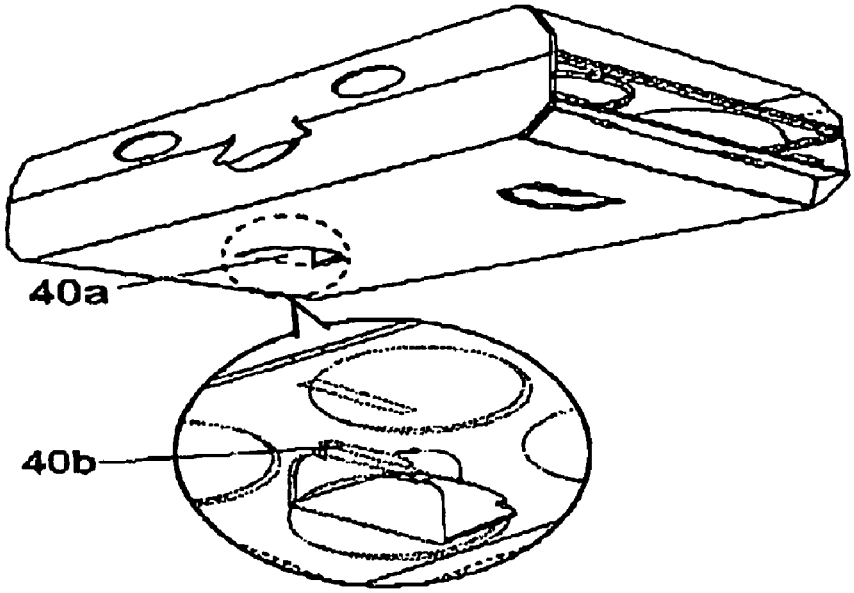
FIG. 8 is a view illustrating a state that support holes and support projections of a receiving portion are combined together in order to prevent an eggs packing container according to the present invention from moving.

FIGS. 7 and 8 are views illustrating states that support holes and support projections of the receiving portion and the lid portion are combine together in order to prevent the eggs packing container according to the present invention from moving.

As shown in FIG. 7, the support projections 140*a* of the upper surface 12 are characterized in that they are combined with the support holes 140*c* of the second egg inserting plate 27 and the support holes 140*b* of the moving prevention parts 14, thereby fixing the receiving portion 100 to the lid portion 200.

As shown in FIG. 8, the first side surface is pulled outwards to ensure inner space between the receiving portion 100 and the lid portion 200, and then the support projections 40*a* formed on the lower surface 41 of the receiving portion 100 are folded inwards along the fold lines to be combined with the support holes 40*b* of the receiving portion 100, thereby fixing the receiving portion 100 to the lid portion 200.

The procedure of assembling an eggs packing container according to the present invention will be described with reference to FIGS. 9 to 12.

First, the single sheet of the packing container of the present invention is prepared according to the development view shown in FIG. 3 through single press processing. In FIG. 3, the dotted lines and solid lines indicate the fold lines and the cut lines, respectively. Preferably, the fold lines may be provided with intermittently cut marks in constant intervals, thereby making it easy to perform the procedures of assembling and folding the packing container.

Figure 9:
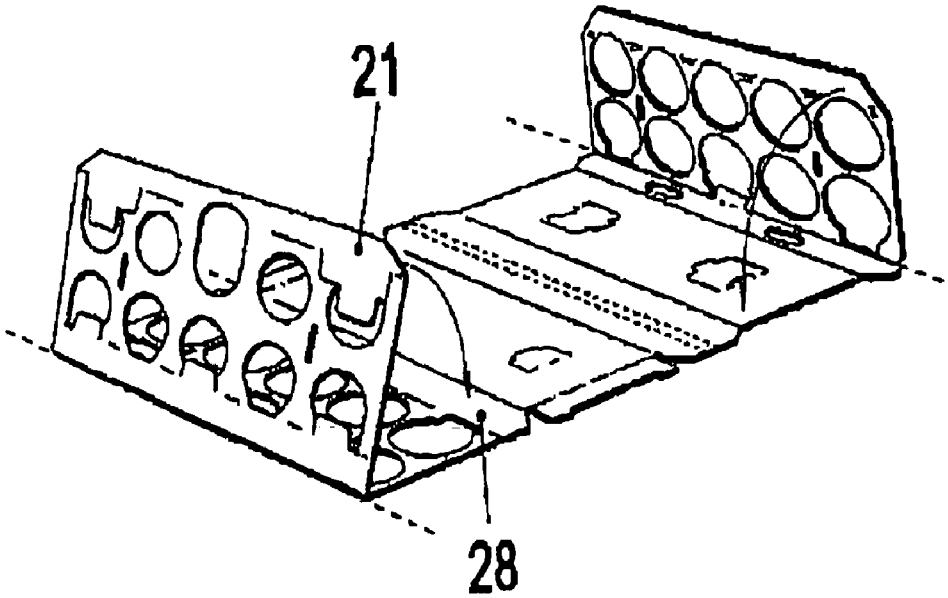
FIGS. 9 to 12 are views illustrating procedure of assembling an eggs packing container according to the present invention.

Next, as shown in FIG. 9, the second connecting stripe 21 of the receiving portion 100 is adhered to the first side surface 28 by means of adherent.

Figure 10:
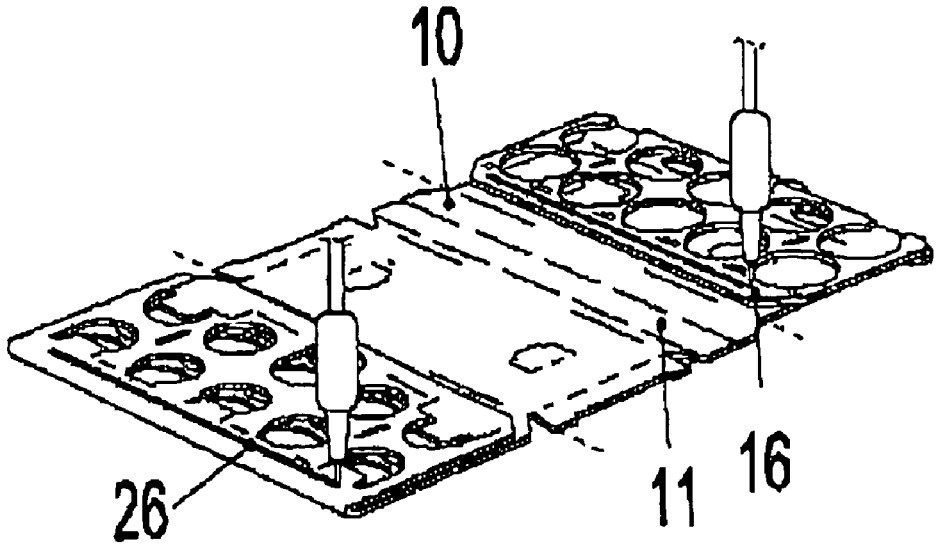
Figure 11:
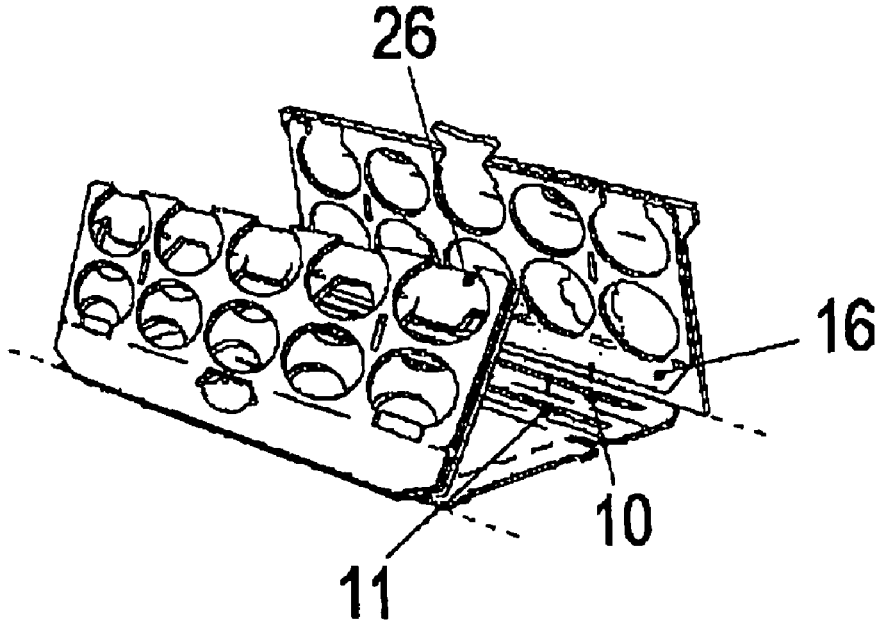

Next, as shown in FIGS. 10 and 11, the third connect stripe 16 of the lid portion 200 is folded inwards along the fold lines, and then adhered to the third side surface 10. In addition, referring to FIG. 10, the folded first connecting stripe 26 is applied with adherent and then adhered to the second side surface 11.

Preferably, the size of the adhered first connect stripe 26, that is, the width of the first connecting stripe 26 excluding the supporter 61 may be a half of the width of the second side surface 11, as a adhered region.

The above mentioned adhered region is pressed without any damages for the packing container through the procedure of assembling shown in FIGS. 9 to 11.

Figure 12:
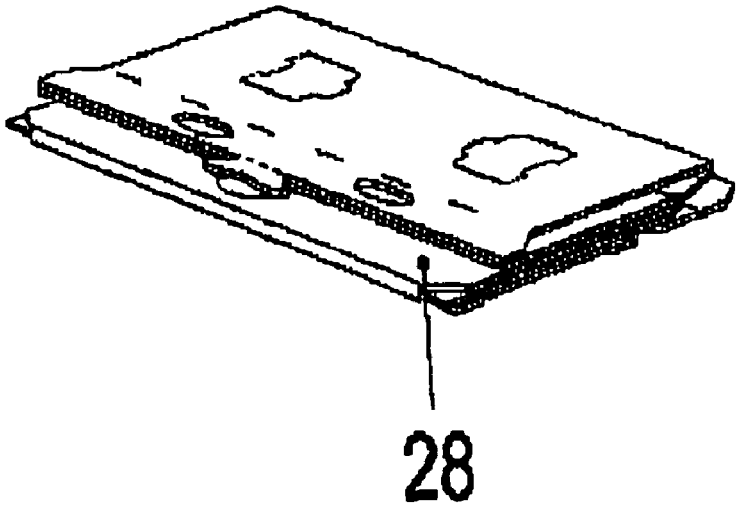
Figure 13:
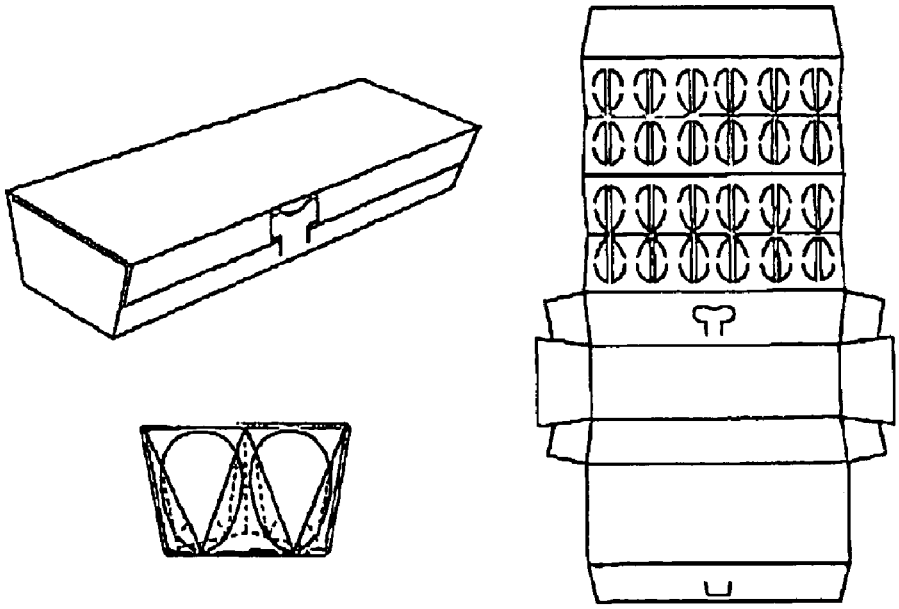
FIGS. 13 and 14 are perspective views an eggs packing container produced with a conventional single sheet.
Figure 14:
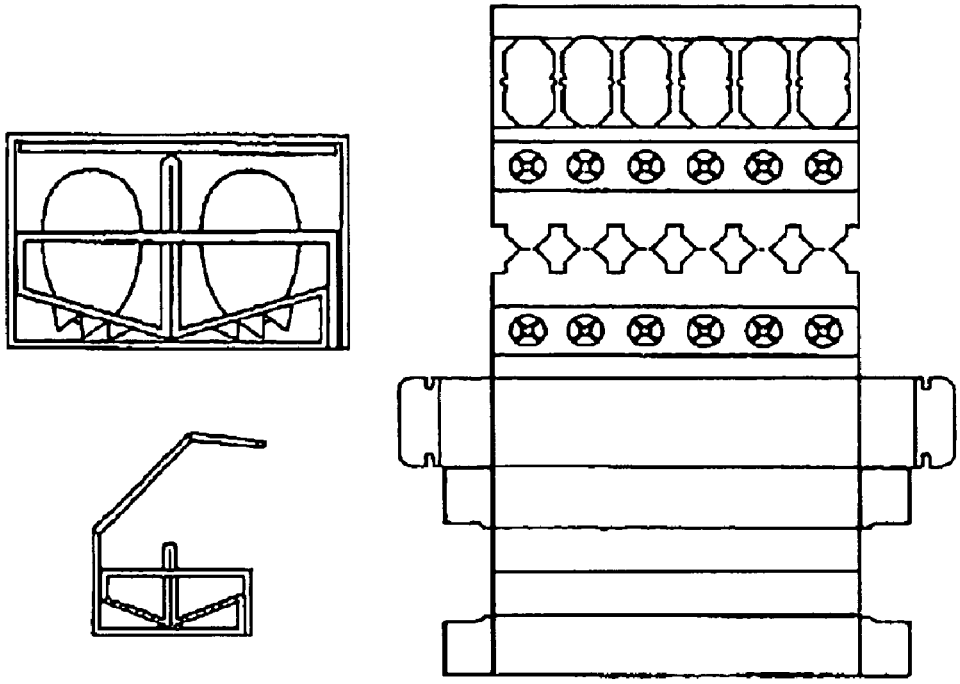

FIG. 12 illustrates the resulting eggs packing container according to the present invention after the adhering procedure. The packing container of the present invention are commercially distributed and stored in the state shown FIG. 12, thereby making use of space economically.

The embodiments described above are not for limiting the range of the present invention, and the present invention may further comprise modifications that can be made by the skilled in the art without the spirit of the present invention within the scope of the claims.

INDUSTRIAL APPLICABILITY

As described in the preferred description of the invention, the present invention has advantages that it can provide an eggs packing container using paperboard, thereby preventing the environments from pollution, and it can provide an eggs packing container having a receiving portion 100 and a lid portion 200 like the shape of the conventional synthetic resin packing container, thereby making use of the existing egg packing production automation facilities.

In addition, the packing container according to the present invention can be made of a single sheet in press processing and in a simplified assembling procedure, thereby being economically adapted to the existing production automation facilities.

The packing container according to the present invention can not be damaged during opening and closing procedures, so that user may use again the used packing container.

Further, the packing container according to the present invention can be easily separated into the receiving portion 100 and the lid portion 200 by users, thereby be convenient for storage.

What is claimed is:

1. An eggs packing container in which a receiving portion and a lid portion are produced using a single sheet of paperboard, wherein:

said receiving portion comprises a lower surface being a bottom plane of said receiving portion, and having a support projection;

a first egg inserting plate being positioned above said lower surface, and having a support hole for engagement with said support projection of said lower surface and a plurality of first inserting holes for inserting received eggs, said support projection of said lower surface being at least partly receivable in said support hole to maintain said lower surface at a constant and fixed distance from said first egg inserting plate;

a second egg inserting plate being positioned above said first egg inserting plate, and having a plurality of second inserting holes disposed to oppose said plurality of first inserting holes of said first egg inserting plate and a support hole;

a first side surface for connecting said second egg inserting plate with said lower surface, said first side surface having a combining hole for coupling said receiving portion with said lid portion which is provided at a central region of said first side surface;

a first connecting stripe for connecting said first egg inserting plate with said second egg inserting plate, and having a supporter;

a second connecting stripe being connected to said first egg inserting plate, and being adhered to said first side surface, and having a fixing projection for supporting said first side surface; and a second side surface being adhered to said first connecting stripe, and connecting said receiving portion with said lid portion, and said lid portion comprises an upper surface for fixing said receiving portion and said lid portion, said upper surface having a support projection to prevent said eggs packing container from moving;

a moving prevention part having a plurality of third inserting holes and a support hole, wherein said third inserting holes are disposed to oppose to said second inserting holes and said support hole is engageable with said support projection of said upper surface;

a third connecting stripe being connected with said moving prevention part;

a third side surface being adhered to said third connect stripe and connecting said receiving portion with said lid portion;

a fourth side surface connecting said upper surface with said moving prevention part, said fourth side surface being provided with a coupling projection, and wherein said support projection of said upper surface is engageable with said support hole of said second egg inserting plate and said support hole of said moving prevention part, thereby releasably fixing and coupling together said receiving portion and said lid portion.

2. The eggs packing container according to claim 1, wherein said third side surface comprises a side surface cutting element, thereby facilitating separating said receiving portion from said lid portion.

3. The eggs packing container according to claim 1, wherein said lower surface comprises a bottom engaging panel, thereby preventing damaged materials of said eggs received in said receiving portion from moving.

4. The eggs packing container according to claim 1, wherein said supporter of said first connecting stripe keeps a spacing distance between said first egg inserting plate and said lower surface constant, thereby protecting eggs received in said receiving portion from external impact.

5. The eggs packing container according to claim 1, wherein said receiving portion is the same size as said lid portion, and said receiving portion and said lid portion are made of a single sheet.

6. The eggs packing container according to claim 1, wherein a width of said combining projection becomes gradually narrower from a lower part to an upper part thereof.

7. The eggs packing container according to claim 1, wherein said combining hole of said first side surface has an upper part the same size as said combining projection for engagement with said combing projection, and wherein a lower part of said combining hole is dimensioned to ensure that users can make use of a wider space for opening and closing said eggs packing container.

8. The eggs packing container according to claim 6, wherein said combining hole of said first side surface has an upper part of the same size as said combining projection for engagement with said combining projection, and wherein a lower part of said combining hole is dimensioned to ensure that users can make use of a wider space for opening and closing said eggs packing container.

* * * * *